US007955238B2

(12) United States Patent
Dokshutsky

(10) Patent No.: US 7,955,238 B2
(45) Date of Patent: Jun. 7, 2011

(54) WHEELCHAIR-ACCESSIBLE FITNESS SYSTEM

(75) Inventor: Leo Dokshutsky, Mountlake Terrace, WA (US)

(73) Assignee: Leo D Novsky, Mountlake Terrace, WA (US)

( * ) Notice: Subject to any disclaimer, the term of this patent is extended or adjusted under 35 U.S.C. 154(b) by 121 days.

(21) Appl. No.: 11/945,267

(22) Filed: Nov. 27, 2007

(65) Prior Publication Data

US 2008/0161162 A1 Jul. 3, 2008

Related U.S. Application Data

(60) Provisional application No. 60/882,776, filed on Dec. 29, 2006.

(51) Int. Cl.
*A63B 21/04* (2006.01)
*A63B 21/02* (2006.01)

(52) U.S. Cl. ..... 482/129; 482/121

(58) Field of Classification Search ..... 482/1, 8, 482/92–94, 904, 910, 142, 121, 122, 123, 482/129, 148; 601/23; D21/662, 686, 690; 280/304.1

See application file for complete search history.

(56) References Cited

U.S. PATENT DOCUMENTS

| | | | | | |
|---|---|---|---|---|---|
| 4,153,244 | A | * | 5/1979 | Tauber, Jr. | 482/94 |
| 4,747,595 | A | * | 5/1988 | Mabry et al. | 482/99 |
| 4,765,614 | A | | 8/1988 | Shute | |
| 4,976,428 | A | * | 12/1990 | Ghazi | 482/133 |
| 5,031,605 | A | | 7/1991 | Mills | |
| 5,044,629 | A | * | 9/1991 | Ryan et al. | 482/101 |
| 5,048,827 | A | | 9/1991 | Caruso | |
| 5,123,886 | A | * | 6/1992 | Cook | 482/129 |
| 5,277,685 | A | * | 1/1994 | Gonzales | 482/134 |
| 5,343,856 | A | | 9/1994 | Proctor | |
| 5,536,228 | A | * | 7/1996 | Tanner, Jr. | 482/130 |
| 5,762,593 | A | | 6/1998 | Whitely | |
| 5,839,995 | A | * | 11/1998 | Chen | 482/92 |
| 5,961,430 | A | | 10/1999 | Zuckerman et al. | |
| 6,443,877 | B1 | * | 9/2002 | Hoecht et al. | 482/103 |
| 6,712,744 | B2 | | 3/2004 | Buechel, Jr. et al. | |
| 6,716,143 | B1 | | 4/2004 | Martin | |
| 7,144,353 | B2 | | 12/2006 | Sjuragari | |
| 7,226,396 | B2 | | 6/2007 | Buechel, Jr. et al. | |
| 7,306,548 | B2 | | 12/2007 | Martin et al. | |
| 7,354,384 | B2 | | 4/2008 | Martin et al. | |
| 2001/0001776 | A1 | | 5/2001 | Jones | |
| 2002/0111254 | A1 | * | 8/2002 | O'Hearn | 482/134 |
| 2002/0123415 | A1 | * | 9/2002 | Marques | 482/123 |
| 2004/0097333 | A1 | * | 5/2004 | Nappari | 482/41 |
| 2004/0110610 | A1 | * | 6/2004 | Chen et al. | 482/123 |
| 2005/0187083 | A1 | | 8/2005 | Krystoff | |
| 2005/0215400 | A1 | | 9/2005 | Nerenberg | |
| 2007/0010375 | A1 | | 1/2007 | Corte | |
| 2007/0054786 | A1 | | 3/2007 | Piane | |
| 2007/0265146 | A1 | | 11/2007 | Kowalczewski et al. | |
| 2007/0299371 | A1 | | 12/2007 | Einav et al. | |

* cited by examiner

*Primary Examiner* — Loan Thanh
*Assistant Examiner* — Sundhara M Ganesan

(57) ABSTRACT

Wheelchair-accessible fitness systems are described to provide total body strength, range of motion, and cardiovascular training to users in retirement and rehabilitation settings. Resistance is provided through a collection of resistance bands that are designed for low-stress and high-efficacy use. Additional system functionality can be incorporated to provide physical-therapist options for controlled rehabilitation exercises. Sensors can be connected to the resistance bands to provide important user-generated data, which can be collected and managed. The systems can accommodate any type of chair, rehabilitation ball, or wheelchair assembly. The systems are optionally collapsible and portable.

7 Claims, 6 Drawing Sheets

WHEELCHAIR-ACCESSIBLE FITNESS SYSTEM

PRIORITY DATA

This application claims priority under 35 U.S.C. 120 from U.S. Provisional Patent Application No. 60/882,776 for "Wheelchair Accessible Fitness System" which is hereby incorporated herein by reference for all purposes.

FIELD OF THE INVENTION

The present invention generally relates to a fitness system. More specifically, the present invention relates to exercise and rehabilitation equipment.

BACKGROUND OF THE INVENTION

Elderly and disabled persons (persons recovering from surgery or debilitating disease) frequently are limited in their ability to exercise due to their lack of mobility, lack of access to usable equipment, and lack of additional personnel often needed for transfers to available exercise equipment. In addition, lack of adequate space and personnel needed to offer exercise services can become prohibitive to the retirement communities as well as physical-therapy and rehabilitation centers where such persons seek treatment. Similar challenges can be further exacerbated in a home setting, where little to no additional help or equipment can be readily offered. While the goals of people going through these challenges vary, attaining a better quality of life and regaining their degree of functional independence are some of the major goals of this population.

Various devices exist to provide strength, cardiovascular, and range-of-motion training to users in retirement and rehabilitation settings. Although arguably effective for their intended purposes, the machines known in the art often prove to be inaccessible or unusable and require users to transfer to and from the equipment, and can prove to be too bulky, inaccessible, or complicated for their intended use.

It is therefore desirable to provide exercise and rehabilitation equipment that can effectively strengthen all major muscle groups, provide tools to increase a user's range of motion and ability to improve cardiovascular fitness, as well as to provide ambulatory training in a safe, effective, and function-sensitive manner.

What is needed is a fitness system that can be portable, user-friendly, safe, and easy to use with minimal assistance. The fitness system should be designed to accommodate any type of chair, rehabilitation ball, wheelchair assembly, or any other means for seating. The present invention, as described herein, addresses these known needs in the art.

SUMMARY OF THE INVENTION

The present invention provides fitness systems that can satisfy the aforementioned needs. In some embodiments, the system can be a folding L-shape reinforced frame designed to accommodate any type of chair, rehabilitation ball, or wheelchair assembly. In various embodiments, the system can provide total body strength, range-of-motion, and cardiovascular training. The system can be easily accessible, user-friendly, safe, and utilized with minimal assistance. The system can use little space when folded.

In some embodiments, the invention provides systems comprising:

(i) a platform capable of accommodating a seating apparatus;

(ii) a pair of pivot joints that allow the platform to fold substantially adjacent to a back platform;

(iii) a set of small wheels that allow the system to be moved when in a folded position; and (iv) a set of support side bars.

The systems can further include an exercise bar assembly that allows row-like upper-body and/or walk-like lower-body cardiovascular movement, changes the angle of the exercise bars through a cam system that controls the resistance, and has the ability to lock in various positions, thereby imparting the capability to support additional weight, protecting the user from accidental falls.

The systems can further include adjustable resistance bands—at least two individual bands that are attached to a frame and can be individually removed and adjusted, and handles that are connected to the frame with retractable reel lines, allowing a resistance band to return to its original position.

The seating apparatus can be selected from the group consisting of a chair, a wheelchair, a power-chair, and a fitness ball. In some embodiments, a chair can be built into the system and can optionally be used or can be folded up to accommodate another seating apparatus.

In various embodiments, the systems can further comprise a floor platform that allows multiple attachments of resistance bands used for upper and lower body exercises. The systems can also include a crossbar that can be secured onto the exercise bars. Additionally, the systems can comprise fulcrum arms that attach the floor platform to arch sides, wherein a locked position provides rigidity for exercise and wherein an unlocked position allows the floor platform to fold up.

In embodiments, the systems can include a pulley system attached to arch sides to allow passive range-of-motion exercises with a cable. The systems can also include quick-release levers that allow removal of at least part of a top arch. The systems can use a back support pad that rotates freely onto the seating apparatus, and that provides structural stability against the leaning weight of the user. Also, retractable cords can be utilized, which hold the resistance bands in easily accessible positions.

In some embodiments, the invention provides systems comprising:

(i) a platform capable of accommodating a seating apparatus;

(ii) an exercise bar assembly;

(iii) support side bars;

(iv) adjustable resistance bands; and (v) electronic sensors connected to the resistance bands, wherein the sensors measure tension.

The systems can include a computer capable of being programmed with software that can generate exercise programs. In some embodiments, the computer is capable of reading a user identification card. The systems can also include a screen that provides visual instructions and/or vocal instructions.

The invention also provides methods of using data that is generated by a fitness system, the method comprising:

(i) providing a fitness system that includes a plurality of sensors, wherein the sensors measure the resistance, number of repetitions, and the range of motion caused by the exercise of a user;

(ii) collecting data that is generated by the sensors, and storing the data in a data-storage medium; and (iii) using the data for the purpose of generating, adjusting, or customizing a fitness program for the user.

In some methods of the invention, the data-storage medium is a computer that is connected to the internet. The methods can also include e-mailing the data and/or information deriving from the data, to a person or to a computer server.

In some embodiments, the methods further comprise the step of providing a web interface to allow access to the data and/or to information deriving from the data.

In certain embodiments, the fitness program from step (iii) is later displayed on a screen for the user.

DETAILED DESCRIPTION OF EMBODIMENTS OF THE INVENTION

The apparatus and methods of the present invention will now be described in detail by reference to various non-limiting embodiments of the invention.

Unless otherwise indicated, all numbers expressing dimensions, strengths, and so forth used in the specification and claims are to be understood as being modified in all instances by the term "about." Without limiting the application of the doctrine of equivalents to the scope of the claims, each numerical parameter should at least be construed in light of the number of reported significant digits and by applying ordinary rounding techniques.

In one object of the invention, fitness systems can be designed to provide total body strength, range of motion (ROM), balance, and cardiovascular training. The invention can be further described, at least in part, by reference to certain non-limiting exemplary embodiments depicted in the appended drawings. Some embodiments relate to the portable system shown in FIG. 1 and its numbered elements.

Figure 1:
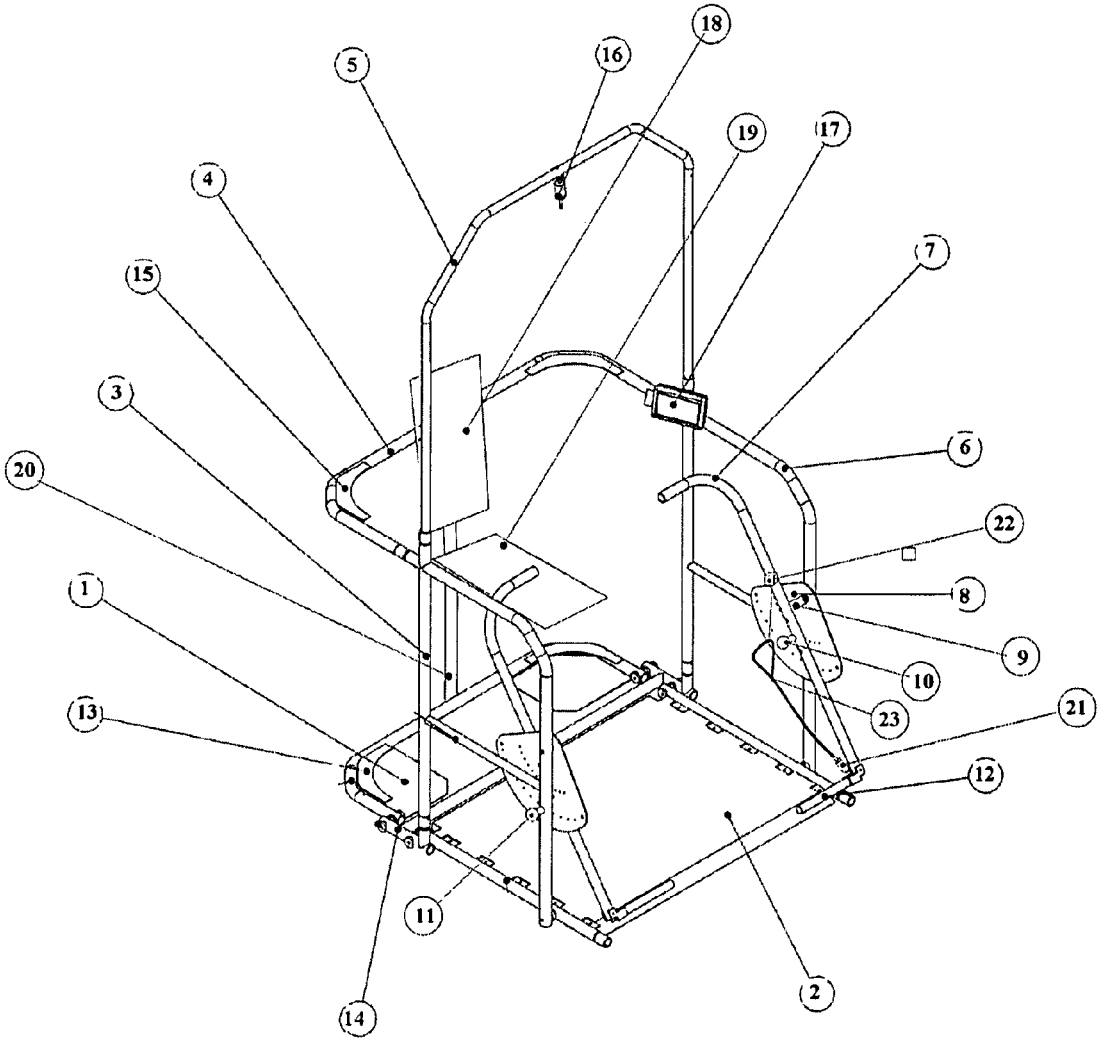
FIG. 1 is a depiction of the system of the invention, according to one embodiment.

In particular, the system depicted in FIG. 1 comprises a floor base 1, a floor platform 2, arch supports 3, a horizontal back support 4, a top arch 5, support side bars 6, a cam 7, an exercise bar 8, an exercise rotation pin 9, a rotation pin 10, a lock pin 11, a foot petal 12, a floor clip plate 13, a floor pivot 14, a horizontal clip plate 15, a sensor 16, a computer screen 17, a back support 18, a folding seat 19, a seat support bar 20, a sensor unit 21, a reel 22, and resistance bands 23. Various embodiments of the invention can have fewer or more than the specific elements described in FIG. 1, as will be described below.

Some systems of the invention can include a framework consisting of a floor base 1 and arch supports 3 with support side bars 6 that can accommodate any type of chair, rehabilitation ball, or wheelchair assembly. In some embodiments, the systems can use a combination of resistance bands 23 to provide weight-bearing exercise in a safe and beneficial manner. In certain embodiments, the systems can include exercise bars 8 that can lock in stationary positions and can be used as an aid for standing exercises. In some embodiments, the systems of the invention are capable of being easily folded and transported by the participants themselves, by utilizing a combination of pivot joints 14 and fulcrum supports.

In some embodiments of the invention, the system includes a floor platform 2 that connects to a floor base 1 through two pivot joints 14 and to support side bars 6. The floor base 1 is connected to the floor platform 2 and to arch supports 3. The arch supports 3 attach to the floor base 1 and are further preferably stabilized by being connected to a horizontal back support 4 and a top arch 5, as well as having rotating support side bars 6. The top arch 5 attaches to the arch supports 3 and includes several connection points for the attachment of the resistance bands 23 and a range-of-motion (ROM) pulley 22.

The horizontal back support 4 attaches to the arch supports 3 and includes a connector to a back pad and several connection points for the attachment of resistance bands 23. Resistance bands 23 of varying strengths are preferably interchangeable and have handles specifically designed for ease of grip and/or foot insertion.

The support side bars 6 are preferably capable of moving around the arch sides and of being locked and unlocked from the attachment on the floor platform 2 as well as to the exercise bars 8. A back support 18 is attached to the arch supports 3 and can rotate into place to provide increased comfort and ROM and to secure the chair to the frame. A ROM cable pulley system can be attached to the top of the back support. This pulley can allow a person to use alternate active arm movement to increase passive ROM of the opposite arm.

The exercise bars 8 can rotate around the pin 9 connected to the support side bars 6 and can be constructed using a pin-enabled cam 7, rotating handle bars, and folding foot rests. The cam can control the angle of rotation of the exercise bars 8 and can be used to lock them in static position. Foot rests can preferably adjust in height on the exercise bars and optionally fold out of the way. The handle bars can preferably adjust in height and rotate out of the way on the exercise bars. This can offer a convenience for users when they are entering or exiting the system. Also, when the handle bars are rotated inward and face together, a means of fall protection can be offered.

In some embodiments, additional attachments can be used to offer further functionality. With the possibility for multiple attachments, trainers and facilities can customize fitness systems for a plurality of users. For example, parallel-bar attachments can be added to help a person train to walk again or for hip-replacement therapy, and the like.

Figure 2:
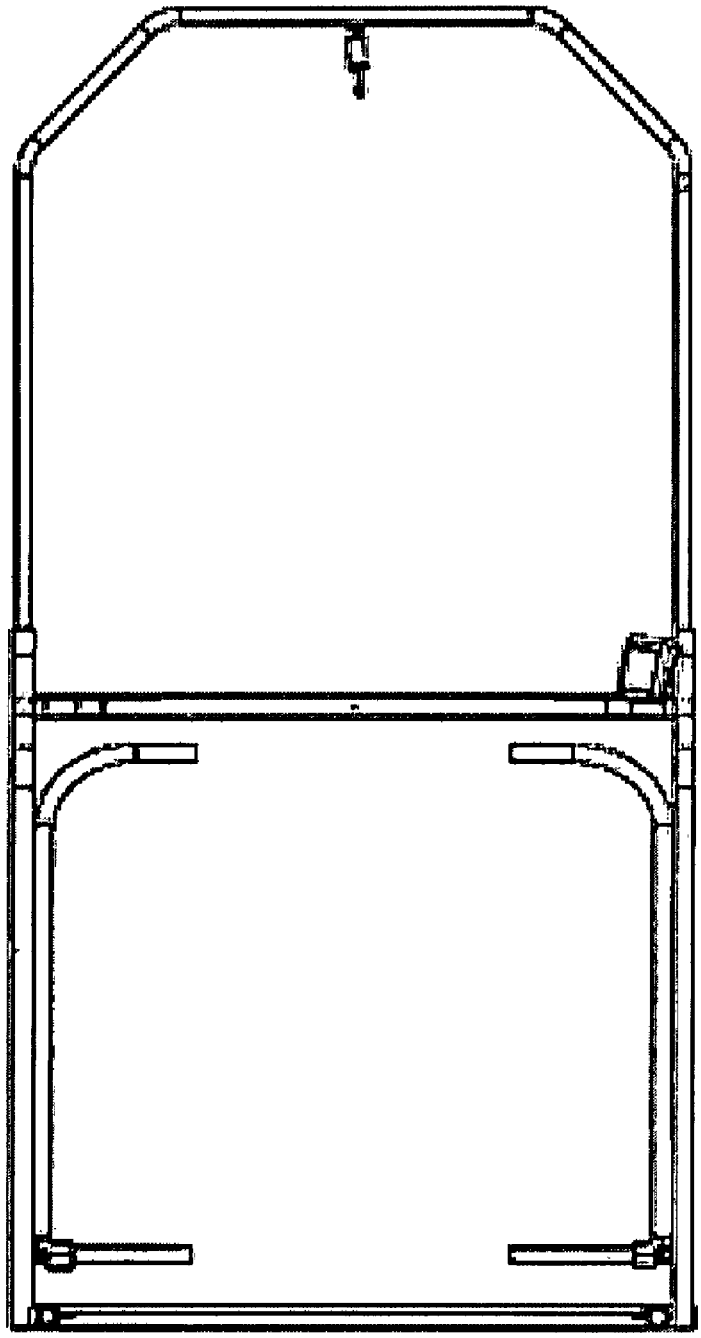
FIG. 2 is a front view of the system of FIG. 1.
Figure 3:
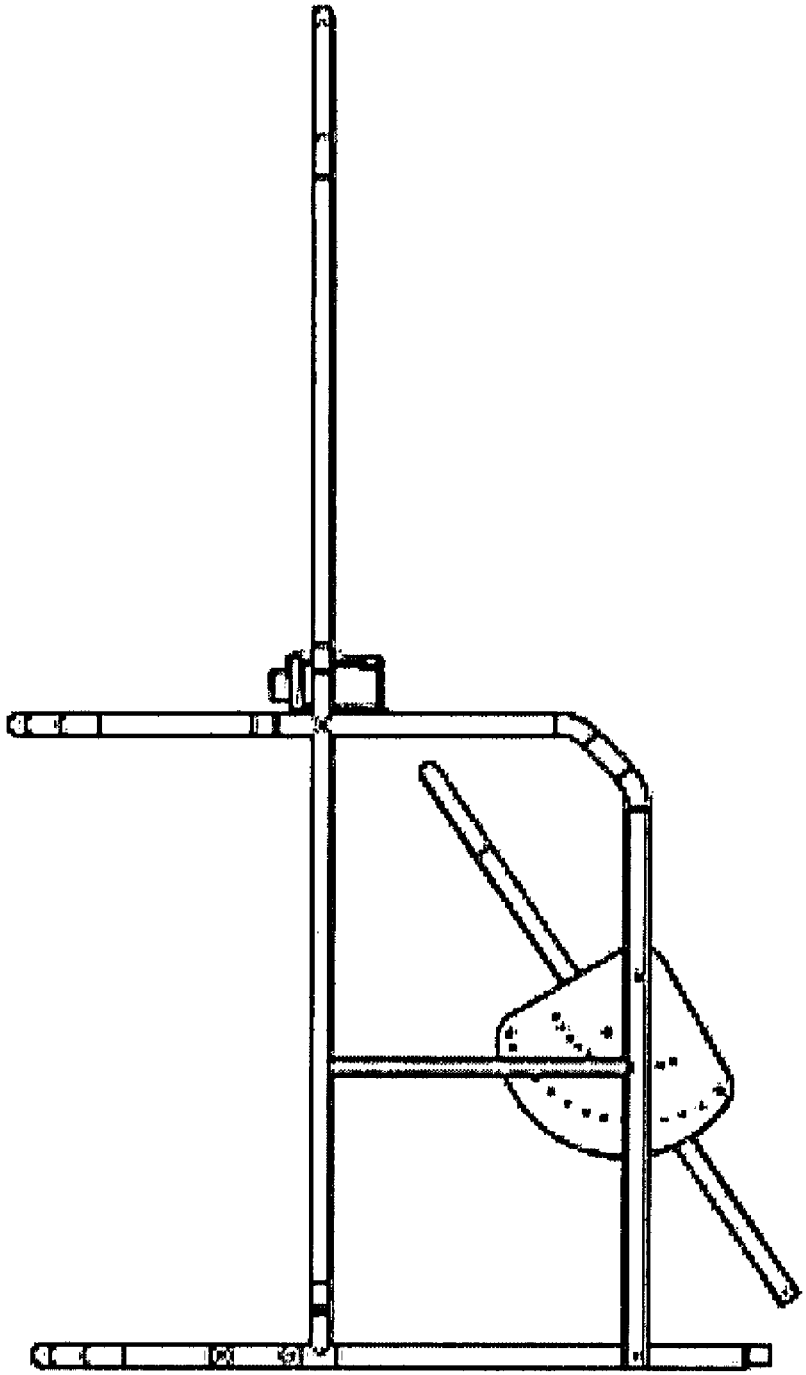
FIG. 3 is a side view of the system in FIG. 1.
Figure 4:
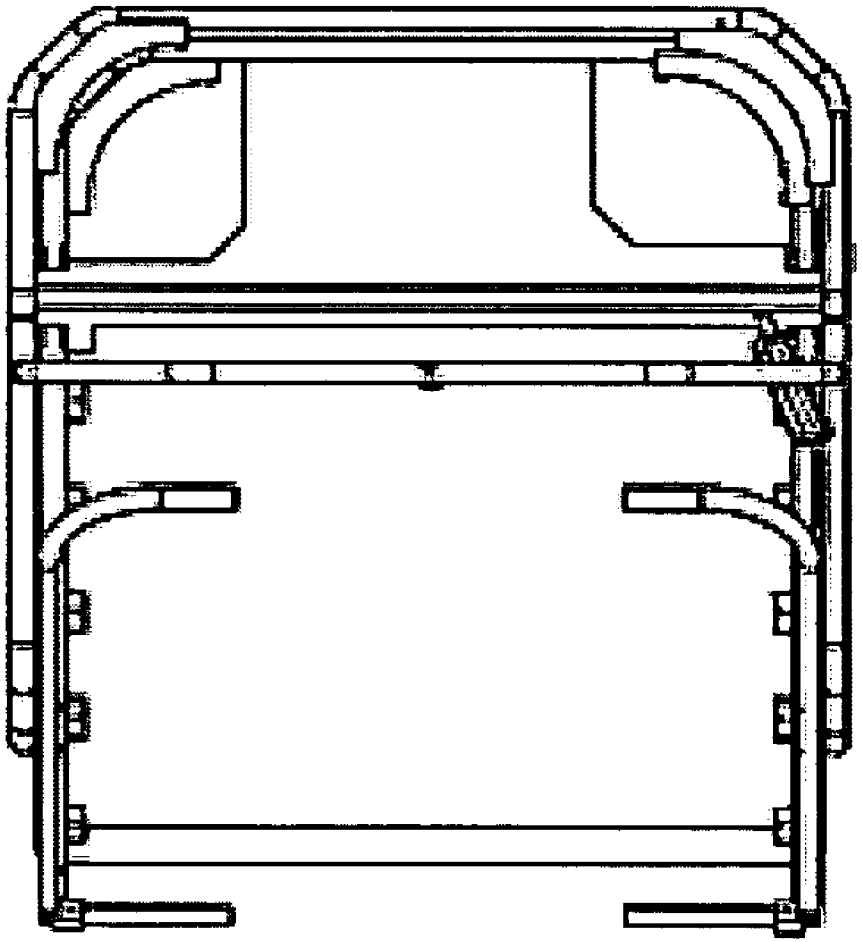
FIG. 4 is a top view of the system of FIG. 1.

FIG. 2 is a front view of the system of FIG. 1, according to some embodiments. FIG. 3 is a side view of the system in FIG. 1, showing exercise bars with handle bars and foot rests extended. FIG. 4 is a top view of the system of FIG. 1.

Figure 5:
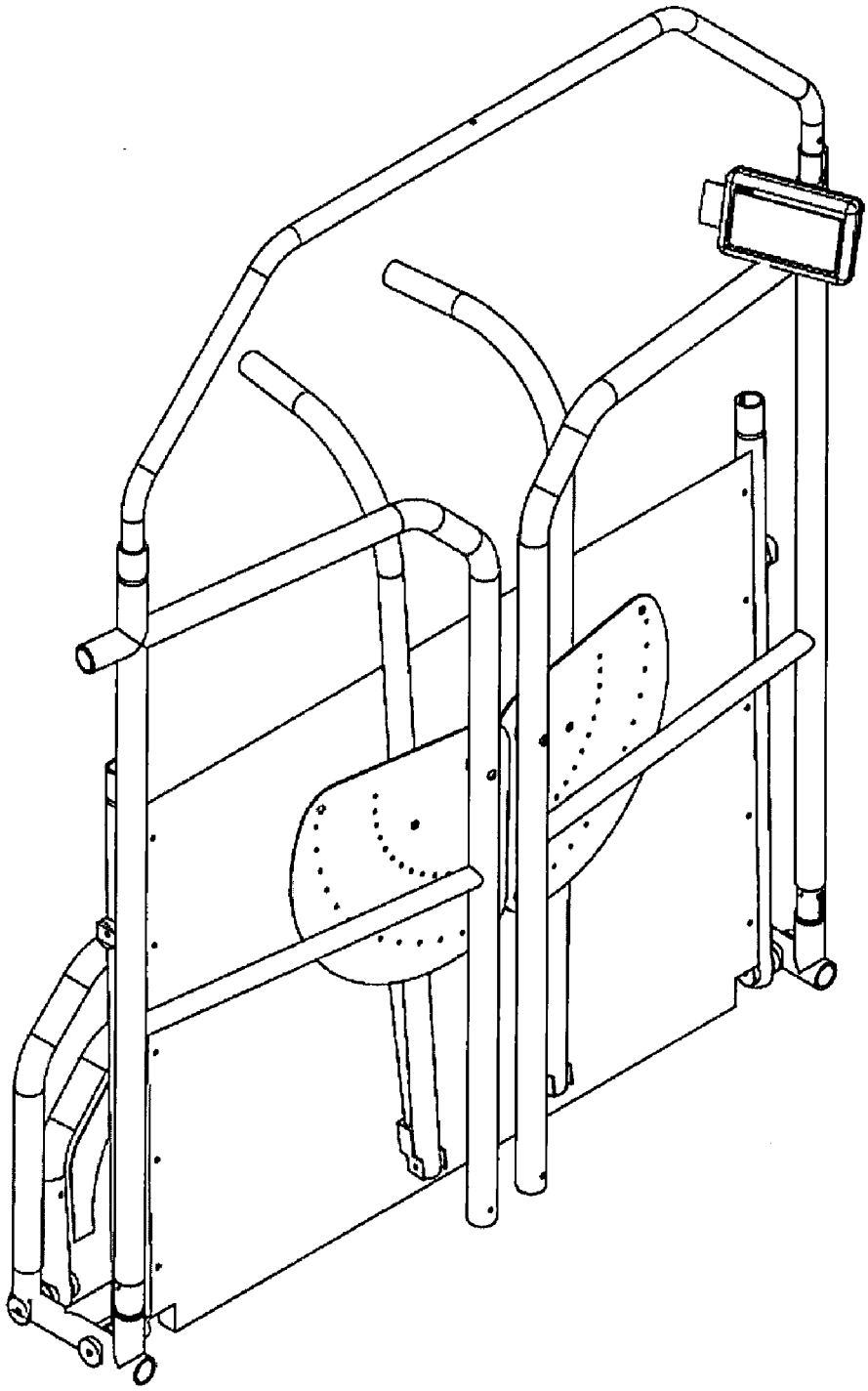
FIG. 5 is a depiction of a system in collapsed and portable form.

In some preferred embodiments, the system can be collapsed and transported. In FIG. 5, a system according to some embodiments is shown in a collapsed position, with the support side bars folded and with the floor platform and floor base folded up.

Another object of the present invention provides fitness systems intended for larger communities and rehabilitation centers. These systems are free-standing and optionally foldable, to reduce the footprint when not in use. These systems can give the user confidence to use the system without help.

In some embodiments of the second object of the invention, systems can give the feel of substance and quality expected in a commercial gym environment. For example, these systems can be designed with steel tubing that is bent, swaged, and welded. The moving parts can be designed using bushings and bearings to increase life and feel.

In certain embodiments, additional system functionality can be incorporated to provide physical-therapist options for controlled rehabilitation exercises.

In some embodiments, Smart Card Technology can be incorporated into systems of the invention. This technology, which is known in the cellular-phone industry, can allow user information to be stored on a small card that can identify the user to the machine, allowing a customized training session to be designed ahead of time.

Figure 6:
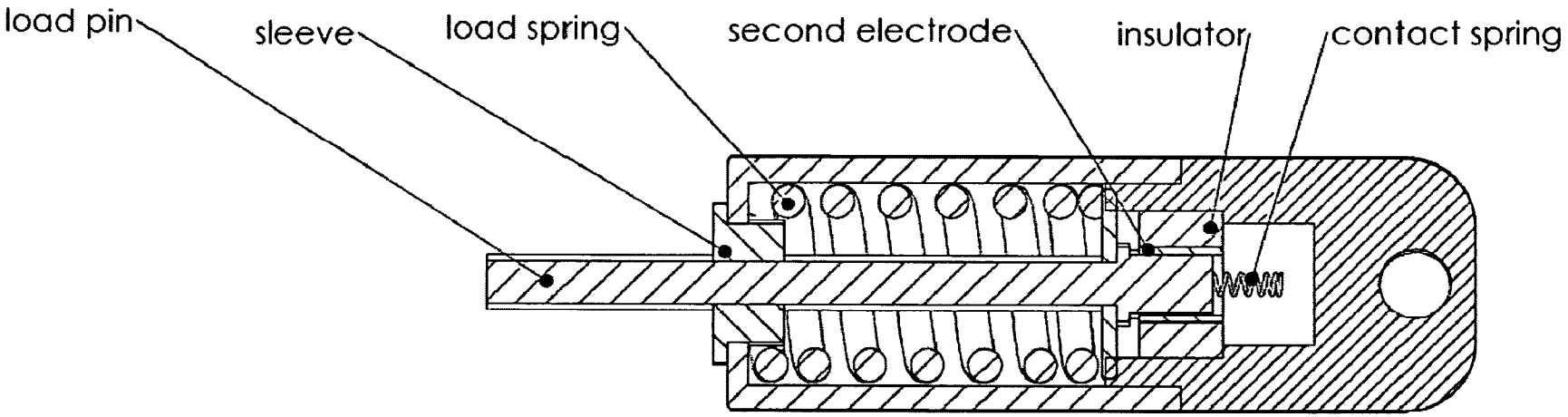
FIG. 6 is an illustration of a sensor that can be incorporated into systems of the invention.

In some embodiments of the systems of the invention, one or more electronic sensors can be utilized. On the end of one or more resistance bands of the system, a sensor can be included to measure tension. The sensor can be designed to measure forces in the range of, for example, 1 to 100 lb-force or some other range of interest. The sensor can use capacitance to measure movement, as is well-known to a person of ordinary skill in the art. Each sensor can send tension data to a controller that can process the data and perform calculations on the data. These calculations can result in quantities such as number of repetitions, range of motion, calories burned, and so on. FIG. 6 shows one exemplary illustration of a sensor.

In some embodiments, the systems can include computers and screens, wherein the computers can be programmed with software that can allow the user to have workouts preprogrammed for them. The screen can provide visual and/or vocal instructions. Optionally, the computers are capable of reading an identification card, Smart Card, or other means of identifying a user, so that collected information can be tied to a user.

It is yet another object of the present invention to provide methods and processes of generating, managing, and using data that is collected at various fitness systems as provided herein. This object provides the ability to collect, analyze, and use the wealth of information that the sensors can provide. It further provides an efficient means for tailoring fitness programs and for monitoring those programs, and for reducing paperwork.

In certain embodiments of this third object, information about each user's workout can be generated and stored at an offsite computer server. Further, the information can be emailed directly to a trainer, a physical therapist, or the user. This information can then be used to customize training programs or for other uses, as can be appreciated.

In some embodiments, a web interface can be provided to allow fitness professionals to access information about their clients and to design virtual workouts that can be displayed for the user. Of course, this web interface can be utilized at any location offering an internet connection, which offers a convenient means for fitness professionals to work with clients.

In a certain embodiment of this data-management process, a trainer first inputs a specific program at a web site that can connect to records of all users. When a user scans his identification card, a central processing unit (CPU) recognizes the user and then queries the web site for the user's exercise-related information. The web site sends this information to the CPU, which displays certain information for the user. As the user performs exercise, data is gathered such as number of repetitions, resistance history, and range of motion. This data is collected via sensors connected to resistance bands as described above. The data is reported to the CPU which records the information and sends it to the web site, which records the information and makes it available to the trainer by e-mail, web access, mobile phone, or some other means. The trainer can then analyze the data and make recommendations to the user for future exercise routines.

In this detailed description, reference has been made to multiple embodiments and to the accompanying drawings in which is shown by way of illustration specific exemplary embodiments in which the invention may be practiced. These embodiments are described in sufficient detail to enable those skilled in the art to practice the invention, and it is to be understood that modifications to the various disclosed embodiments may be made by a skilled artisan. Other embodiments that do not provide all of the features and advantages set forth herein may be utilized, without departing from the spirit and scope of the present invention. Such modifications and variations are considered to be within the scope of the invention defined by the appended claims.

The invention claimed is:

1. A system comprising:

(i) a platform disposed substantially horizontal to a floor and dimensionally capable of accommodating a seating apparatus selected from the group consisting of a chair, a wheelchair, a power-chair, and a fitness ball;

(ii) a pair of pivot joints and fulcrum supports having a locked position and an unlocked position, wherein said locked position provides structural rigidity for said system and wherein said unlocked position allows said platform to fold substantially adjacent to a back platform;

(iii) a set of rotatable support side bars reversibly attachable to said platform at two sides of said platform, wherein said support side bars are dimensionally sufficient to protect a user from falling; and (iv) an exercise bar assembly comprising removable elastic bands connected from a frame of said system to a cam and to said exercise bar assembly, wherein resistance is controllable by changing position of said exercise bar assembly relative to said cam, to vary resistance through adjusting elongation of said elastic bands.

2. The system of claim 1, further comprising a floor platform that allows multiple attachments of resistance bands used for upper and lower body exercises.

3. The system of claim 1, further comprising a crossbar that can be secured onto said exercise bars.

4. The system of claim 1, further comprising a pulley system attached to arch sides to allow passive range-of-motion exercises with a cable.

5. The system of claim 1, further comprising quick-release levers that allow removal of at least part of a top arch.

6. The system of claim 1, further comprising a back support pad that rotates freely onto said seating apparatus, and that provides structural stability against the leaning weight of the user.

7. The system of claim 1, further comprising a plurality of retractable cords that hold the resistance bands in easily accessible positions.

* * * * *